US006343842B1

(12) United States Patent
Sauer et al.

(10) Patent No.: US 6,343,842 B1
(45) Date of Patent: Feb. 5, 2002

(54) ROLLER BIT FOR TUNNEL-DRIVING MACHINES WITH SEGMENTED CUTTING RINGS

(75) Inventors: Klaus Dieter Sauer, Petersberg; Guenter Fennel, Burghaun; Ernst Heiderich, Hohenroda; Bernd Ries, Huenfeld; Reinhold Walter, Rosdorf, all of (DE)

(73) Assignee: Boart Longyear GmbH & Co. KG Hartmetallwerkzeugfabrik, Burghaum (DE)

( * ) Notice: Subject to any disclaimer, the term of this patent is extended or adjusted under 35 U.S.C. 154(b) by 0 days.

(21) Appl. No.: 09/310,764

(22) Filed: May 13, 1999

(30) Foreign Application Priority Data

May 13, 1998 (DE) ..... 198 21 404
May 13, 1998 (DE) ..... 198 21 390

(51) Int. Cl.[7] ..... E21B 10/08

(52) U.S. Cl. ..... 299/79.1; 299/110; 299/113; 175/373

(58) Field of Search ..... 299/110, 111, 299/79, 113; 175/373, 350, 351

(56) References Cited

U.S. PATENT DOCUMENTS

| | | | | |
|---|---|---|---|---|
| 1,847,981 A | | 3/1932 | Reed | |
| 1,865,706 A | | 7/1932 | Reed | |
| 2,294,629 A | | 9/1942 | Reed | |
| 3,862,665 A | | 1/1975 | Wallace | |
| 3,870,370 A | | 3/1975 | Winberg et al. | |
| 3,982,595 A | * | 9/1976 | Ott | 175/373 |
| 4,040,493 A | * | 8/1977 | Saxman | 175/374 |
| 4,553,615 A | | 11/1985 | Grainger | |
| 4,793,427 A | * | 12/1988 | Lambson et al. | 175/373 |
| 5,234,064 A | * | 8/1993 | Lenaburg | 175/373 |
| 5,337,843 A | | 8/1994 | Torgrimsen et al. | |

FOREIGN PATENT DOCUMENTS

| | | | |
|---|---|---|---|
| DE | 2821673 B1 | * | 4/1980 |
| EP | 0957232 A1 | * | 11/1999 |
| GB | 2035417 A | * | 6/1980 |
| WO | WO-88/05117 | * | 7/1988 |
| WO | WO91/11588 | | 8/1991 |
| WO | WO97/48873 | | 12/1997 |

* cited by examiner

*Primary Examiner*—David Bagnell
*Assistant Examiner*—John Kreck
(74) *Attorney, Agent, or Firm*—Jordan and Hamburg LLP

(57) ABSTRACT

The present invention provides a roller bit for tunnel-driving machines. Pursuant to the invention, a cutting ring has at least two or more segments. Accordingly, it is possible to renew the cutting ring itself or different parts of the cutting ring segment by segment, without the previously required dismantling and installation of a complete roller bit from a drill head and associated expenses of transporting. A total driving time is thus reduced because of shorter repair times. The segments of the cutting ring are disposed in a fixed position preferably by means of profiled guides on the base roller body and connected with the base roller body by means of segment holding devices which have a screw thread, and/or by means of threaded rings.

10 Claims, 4 Drawing Sheets

Figure 1:
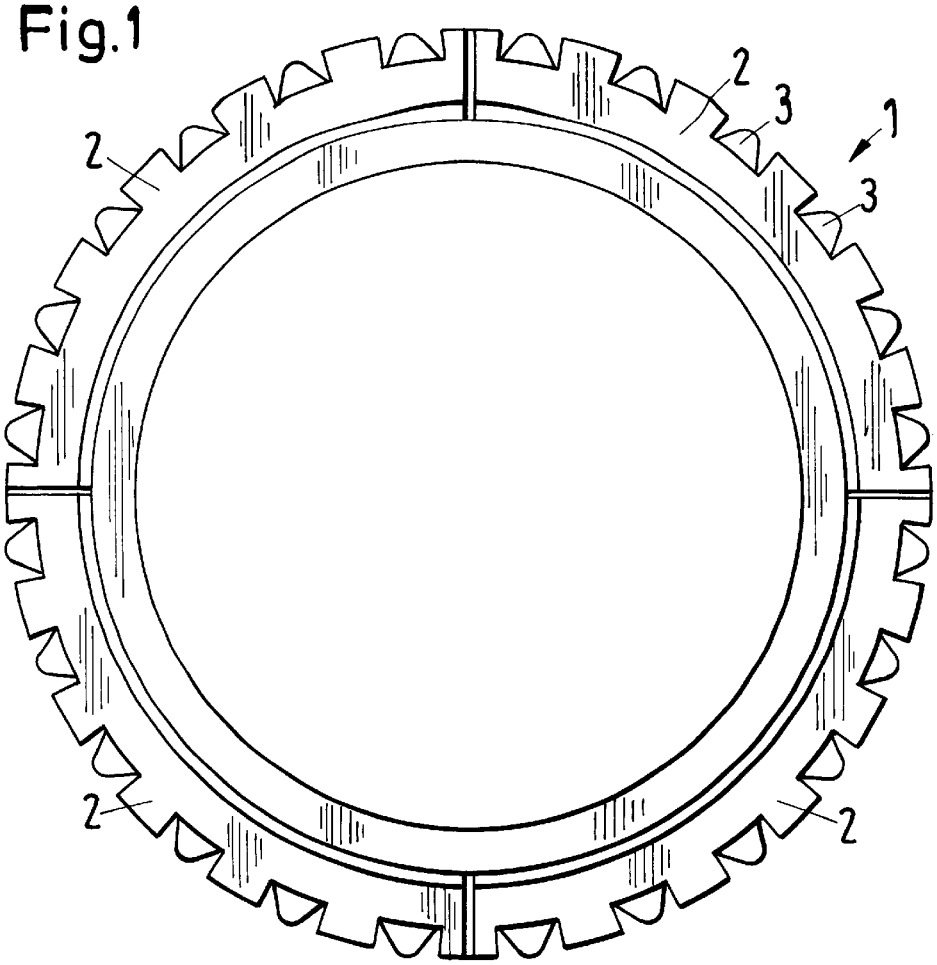

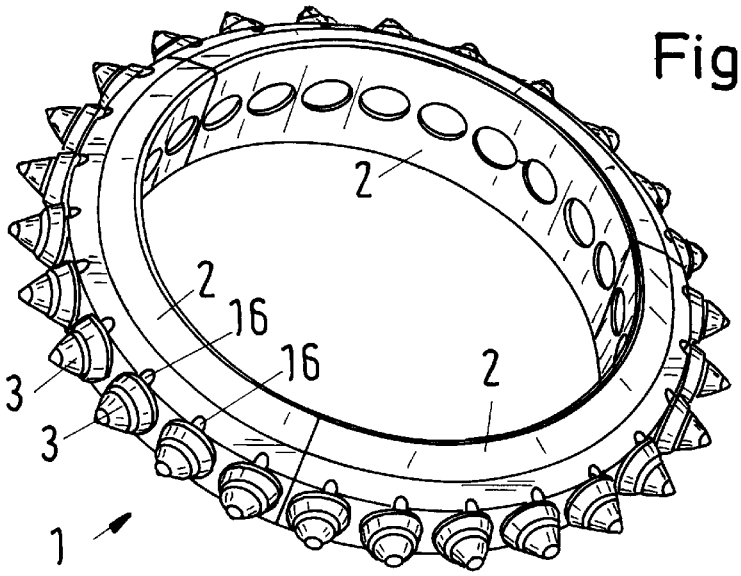
Fig.6
Fig.7
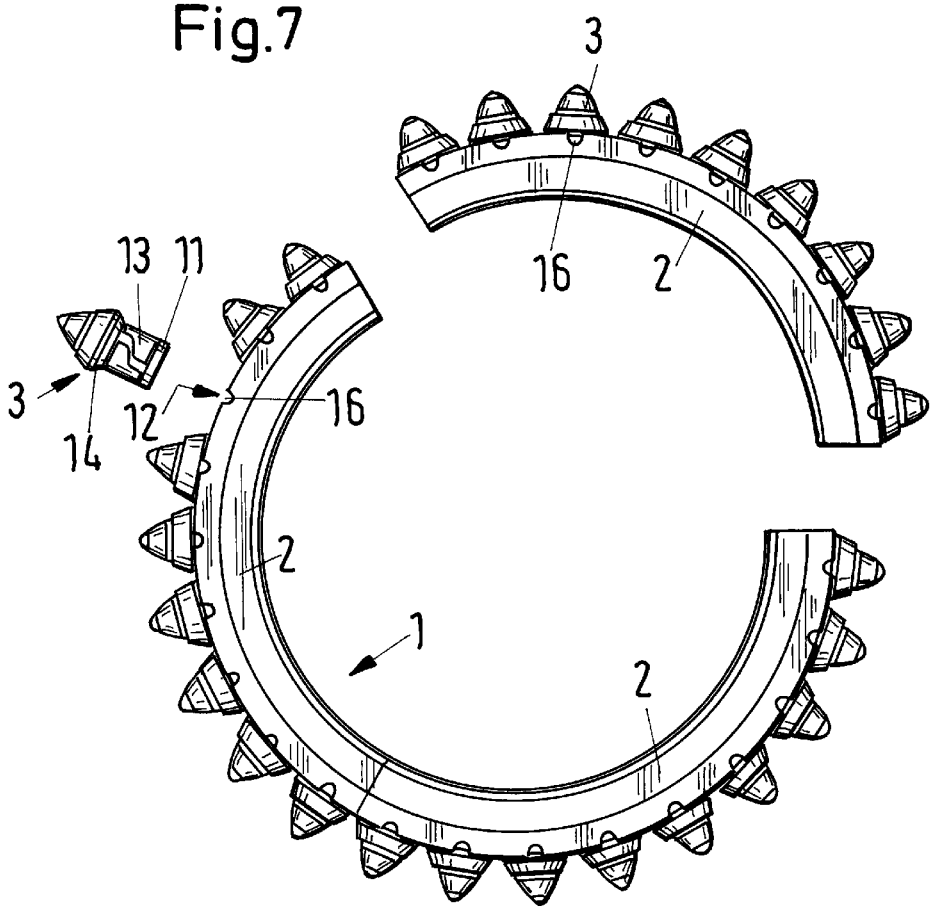

ROLLER BIT FOR TUNNEL-DRIVING MACHINES WITH SEGMENTED CUTTING RINGS

BACKGROUND OF THE INVENTION

The invention relates to a roller bit for tunnel-driving machines.

Known tunnel-driving machines are equipped with cutting heads and roller bits, which are provided with cutting elements, such as cutting rings carrying cutting pins, and which are formed as one part. These cutting rings are pressed or shrunk onto a cutting body or secured there by means of a retaining ring and groove. Moreover, cutting rollers without cutting rings are known, for which the cutting pins are soldered or shrunk directly into a base body of the roller bit. The cutting rings and the cutting rollers, which are provided with cutting pins, can have different profiles.

It is a disadvantage of the known embodiments that, in the event that a repair becomes necessary, the complete roller bit or its cutting ring must be exchanged as a whole, even if only partial regions of the cutting ring are affected. This causes long repair times, as well as expenses, which cannot be justified, since the roller bit must be dismantled completely from a drilling head, so that such a repair can be carried out.

SUMMARY OF THE INVENTION

It is therefore an object of the invention to provide a generic roller bit for tunnel-driving machines which does not have the disadvantages of the known technical solutions.

This objective is accomplished by a cutting ring having at least two or more segments which are fastened exchangeably to the base roller body. By these means, it is possible to replace the cutting ring itself or worn parts of the cutting ring segment by segment, without the previously required dismantling and assembly of a complete roller bit from a drilling head with the therewith associated transporting costs. A total driving time accordingly is minimized by shorter repair times, since the segments of the cutting ring can be exchanged on site. Furthermore, material costs are decreased.

The segments of the cutting ring can be disposed in a specified position by means of profiled guides positively, preferably with a dovetail guide or a T-shaped groove and adapters on a base roller body and connected to the base roller body by means of segment holding devices with a screw thread and/or by means of threaded rings.

The invention is described in greater detail by means of examples.

IN THE DRAWINGS

Figure 2:
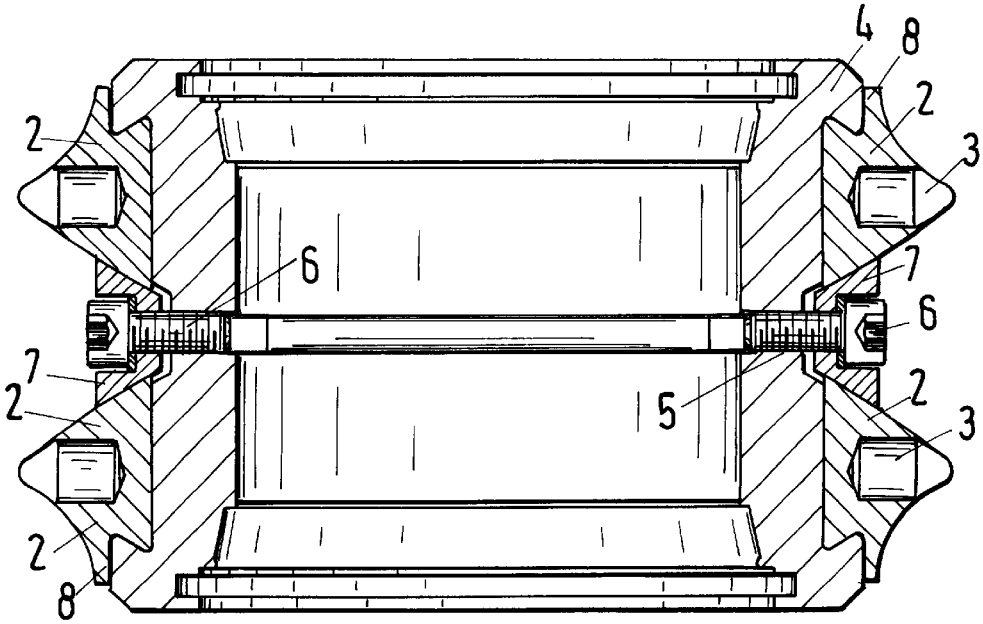
Figure 3:
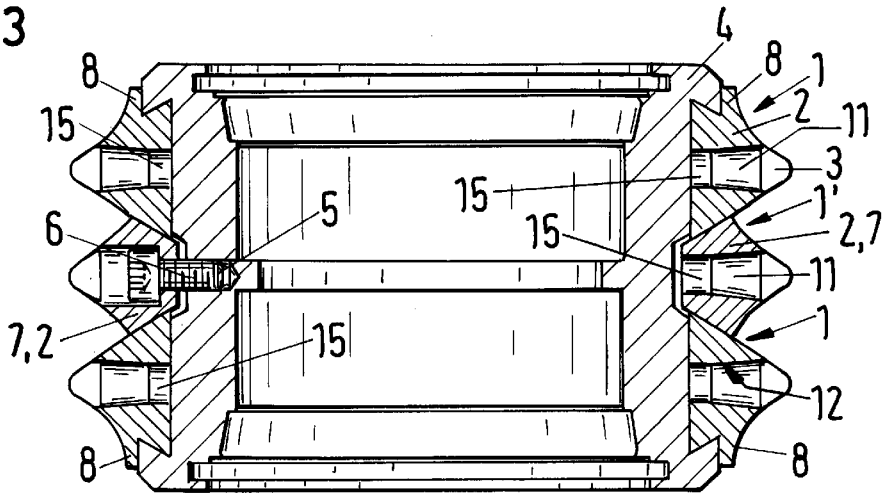
Figure 4:
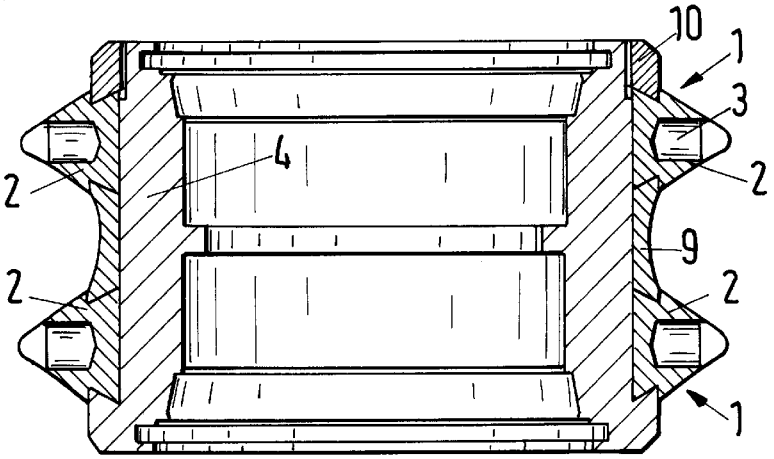
Figure 5:
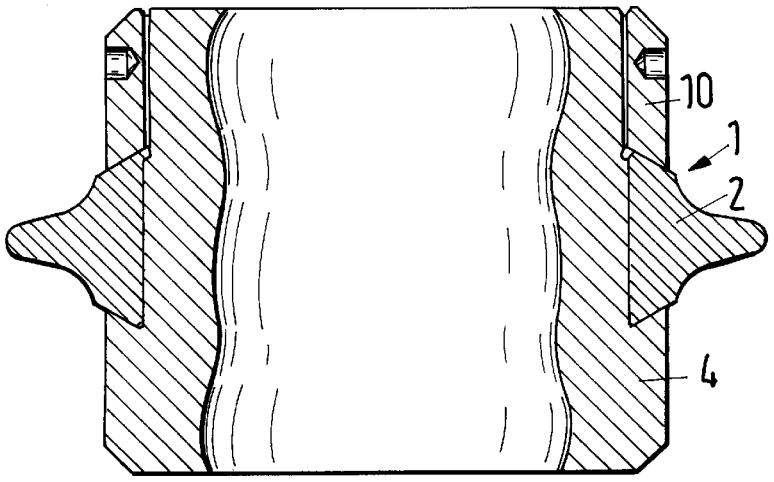
Figure 8:
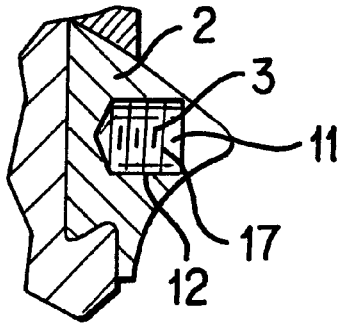

FIG. 1 shows the diagrammatic representation of an arrangement of a cutting body with four cutting ring segments, FIG. 2 shows a sectional representation of an arrangement of a 2-track cutting body in segments, which is fastened to a base roller body by means of a screw connection, FIG. 3 shows a sectional representation of an arrangement of a 3-track cutting body in segments, which is fastened to the base roller body by means of a screw connection, FIG. 4 shows a sectional representation of an arrangement of a 2-track cutting body in segments, with an intermediate ring, fastened by an adjusting nut, FIG. 5 shows a sectional representation of a cutting body with a cutting crown, fastened by an adjusting nut, FIG. 6 shows a perspective representation of a cutting ring with exchangeable cutting elements, FIG. 7 shows a plan view of the object of FIG. 6, and FIG. 8 shows an embodiment of a mounting feature for the cutting elements.

DETAILED DESCRIPTION

FIG. 1 shows an example of a cutting ring 1 having four segments 2. Pursuant to the invention, the number of segments 2 can be between two segments 2 and, depending on the particular application, several segments 2. In the outer periphery of the cutting rings 1, or of the cutting segments 2, cutting elements 3, such as tungsten carbide cutting pins, are inserted. The cutting rings 1 can be disposed so that they are present as one-track, two-track or multi-track rings, that is, several cutting rings 1 can be disposed parallel to one another on the base roller body 4, as shown in the figures. In this connection, it should be mentioned that the diameter of the cutting rings 1 can increase stepwise from the first to the following casting rings in a manner not shown, so that the cutting roller has a conical configuration.

FIG. 2 shows a sectional representation of an arrangement of a two-track cutting body fastened on the base roller body 4. A dovetail recess is incorporated into a periphery of the base roller body 4. In a central region, the recess is offset farther in a wedge-shaped fashion towards an axis of the base roller body 4. In the wedge-shaped central section, a thread is provided, into which a screw 6, holding a fastening element 7, is screwed after the cutting rings 1 have been inserted into the dovetail guides machined on either side. For this arrangement, both of the cutting rings 1 are clamped securely and fast over surfaces by the fastening element 7 against an inside of the dovetail guide. By loosening the screw 6 and removing the fastening element 7, the segments 2 of the cutting rings 1 can be removed and exchanged on site easily and with little effort.

In FIG. 3, the arrangement of a 3-track cutting body with a screw connection is shown. The outer cutting rings 1 once again engage the dovetail guide towards the outside and have a collar 8, which lies on the periphery of the base roller body 4. The inwardly pointing profiles of the outer cutting rings 1 are in a wedge-shaped configuration throughout, so that a central cutting ring 1', which is wedge-shaped on either side, is disposed between the two outer cutting rings 1. Instead of a seat for a cutting pin 3, a through-hole for a screw 6 is provided, with which the outer cutting rings 1 are clamped firmly and securely over the central cutting ring 1' against the dovetail guide of the base roller body 4. This shape of the cutting rings 1, 1' secures the individual segments 2.

FIG. 4 shows a different embodiment of a 2-track cutting body with a dovetail guide disposed at a bottom of the base roller body 4. The segments 2 of the cutting ring 1 are provided on either side with recesses for the dovetail guides, so that their inwardly pointing surfaces enclose an intermediate ring 9, which is provided with a counter-profile. For installing the cutting body, the lower cutting ring 1 is placed against the guide of the base roller body 4. Adjoining this is the intermediate ring 9 as well as the upper cutting ring 1. A clamping nut 10, which is screwed from above with a flat side against the base roller body 4, secures the segments 2 of the cutting ring 1 against the roller body 4 so that they are clamped positively and by friction.

The same type of fastening of the cutting ring 1 or the segments 2 has been selected for the one-track cutting body shown in FIG. 5. However, the cutting ring 1, used there, does not have individual cutting elements. Instead, when the individual segments 2 are assembled, the cutting ring forms a peripheral cutting crown. The individual segments 2 are held, in turn, on the base roller body 4 by a clamping nut 10.

FIGS. 6 and 7 show special embodiments of a cutting ring 1, in which the individual cutting elements 3 are connected detachably with the segments 2 instead of being soldered or shrunk into the segments 2. This makes it possible to take into consideration partial wear of individual segments 2 even better in that only the worn cutting elements 3 have to be exchanged and not the whole segment 2. By these means, even shorter repair and maintenance times are achieved and material required is reduced further. The necessary driving time of the roller bits can thus be decreased even further.

For the embodiments shown in FIGS. 6 and 7, the detachable connection between the cutting elements 3 and the segments 2 is achieved by the cutting elements 3 being constructed with a tool shank 11, which engages an appropriate seat 12 of the segment 2. The tool shanks 11 of the cutting elements 3 of the embodiments, shown in FIGS. 6 and 7, are constructed cylindrically and secured by clamping elements in the seats 12, which are also cylindrical. As shown, these can be disposed as split taper sockets 13 at the tool shank 11 and/or in the seat 12. For loosening the cutting elements 3, there are recesses 16 in the segments 2 in the outer region of each seat 12. Through these recesses 16, a shoulder region 14 of the cutting elements 3 is gripped by a suitable tool and the cutting element 3 forced out of the recess 12.

Other embodiments for the detachable connection between the cutting elements 3 and the cutting rings 1, such as the shape as shown in FIG. 3, with conical tool shanks 11 and corresponding conical seats 12, are possible. The cutting elements 3, clamped in this manner, can be forced out for an exchange through boreholes 15, appropriately provided in the cutting rings 1.

Referring to FIG. 8, it is also possible to screw the cutting elements 3 into the cutting ring 1 so that the tool shank 11 and the seat 12 are provided with appropriate threads 17. As a safety measure, the tool shank 11 and the seat 12, for all types of connection selected, can be provided with mutually matched boreholes for a locking pin. This refinement can also be the sole connection in the case of cylindrical tool shanks 11 and seats 12 without any clamping elements.

The cutting rings 1, in the construction segmented pursuant to the invention, may be formed of different materials, such as steel, steel castings, chilled cast iron or tungsten carbide. Materials may also be paired, for example, by manufacturing the cutting rings 1 of steel and the cutting elements 3, connected therewith, of tungsten carbide. Chisel-shaped cutting elements 3 may be formed uniformly, for example, of tungsten carbide or of different materials, such as a tool shank 11 of steel and a chisel head of tungsten carbide.

What we claim is:

1. A roller bit for reception on a base roller body of a tunnel-driving machine, comprising:

at least one cutting ring being formed as an aggregate of at least two segments, said at least two segments being receivable in separately exchangeable fixed engagement on the base roller body;

a plurality of cutting elements, at least a portion of said plurality of said cutting elements being detachably connected to said at least two segments;

at least one of said plurality of cutting elements being a chisel including a chisel head and tool shank;

said at least two segments including at least one seat in which said tool shank is receivably held; and said tool shank and said at least one seat each having a conical profile.

2. A roller bit for reception on a base roller body of a tunnel-driving machine, comprising:

at least one cutting ring being formed as an aggregate of at least two segments, said at least two segments being receivable in separately exchangeable fixed engagement on the base roller body;

cutting elements detachably connected to said at least two segments; and said cutting elements that are detachably connected having a tool shank with a conical profile and a clamping element for effecting the detachable connection.

3. A roller bit according to claim 2, wherein said at least one cutting ring is tungsten carbide.

4. A roller bit for reception on a base roller body of a tunnel-driving machine, comprising:

at least one cutting ring being formed as an aggregate of at least two segments, said at least two segments being receivable in separately exchangeable fixed engagement on the base roller body;

a plurality of cutting elements, at least a portion of said plurality of said cutting elements being detachably connected to said at least two segments;

at least one of said plurality of cutting elements being a chisel including a chisel head and tool shank; and said at least two segments including at least one seat in which said tool shank is receivably held.

5. The roller bit according to claim 4, wherein said tool shank and said at least one seat include mutually matching threads.

6. The roller bit according to claim 4, wherein said tool shank and said at least one seat each has a cylindrical profile, and at least one of said tool shank and said at least one seat includes a clamping element.

7. The roller bit according to claim 4, further comprising a locking pin, wherein said tool shank and said at least one seat include boreholes which may be brought into mutual alignment for receipt of the locking pin for holding the chisel to the at least one cutting ring.

8. A roller bit according to claim 4, wherein said tool shank has a conical profile and includes a clamping element.

9. A roller bit for reception on a base roller body of a tunnel-driving machine, comprising:

at least one cutting ring presenting cutting structure, said at least one cutting ring being defined at least in part by an aggregate of at least two segments, said at least two segments being receivable in separately exchangeable fixed engagement to the base roller body;

mounting structure for maintaining said exchangeable fixed engagement of said at least two segments to said base roller body;

said at least one cutting ring including cutting rings receivable on the base roller body disposed parallel to one another, said mounting structure including an annular fastening element receivable between adjacent ones of said cutting rings for captive engagement with said adjacent ones; and said annular fastening element being configured as a central cutting ring presenting cutting structure.

10. The roller bit according to claim 9, wherein said at least one cutting ring is tungsten carbide.

* * * * *